US009068328B2

(12) United States Patent
Städtler

(10) Patent No.: US 9,068,328 B2
(45) Date of Patent: Jun. 30, 2015

(54) JET REGULATOR

(75) Inventor: Georg Städtler, Bad Rodach/Gauerstadt (DE)
(73) Assignee: NEOPERL GMBH, Mullheim (DE)

( * ) Notice: Subject to any disclaimer, the term of this patent is extended or adjusted under 35 U.S.C. 154(b) by 871 days.
(21) Appl. No.: 12/441,179
(22) PCT Filed: Sep. 8, 2007
(86) PCT No.: PCT/EP2007/007850
§ 371 (c)(1),
(2), (4) Date: Mar. 13, 2009
(87) PCT Pub. No.: WO2008/037341
PCT Pub. Date: Apr. 3, 2008
(65) Prior Publication Data
US 2009/0230216 A1 Sep. 17, 2009
(30) Foreign Application Priority Data
Sep. 28, 2006 (DE) ..... 10 2006 046 245
(51) Int. Cl.
*E03C 1/084* (2006.01)
*E03C 1/086* (2006.01)
(52) U.S. Cl.
CPC ..... *E03C 1/084* (2013.01); *E03C 1/086* (2013.01)
(58) Field of Classification Search
CPC ..... A62C 31/02; A62C 2/00; B05B 7/00; B05B 7/0433; B05B 7/0491
USPC ..... 239/428.5, 462, 575, 580, 587.1–588, 239/600, 428; 4/675–678; 251/339; 137/801; 403/362; 285/404
See application file for complete search history.

(56) References Cited

U.S. PATENT DOCUMENTS 1,740,156 A * 12/1929 Crane et al. ..... 4/653
2,328,381 A 8/1943 Jaffe
2,510,396 A * 6/1950 Goodrie ..... 239/428.5
4,534,514 A * 8/1985 Aghnides ..... 239/428.5
4,889,165 A * 12/1989 Newcombe et al. ..... 137/801
6,299,180 B1 * 10/2001 Satran et al. ..... 279/83
7,878,426 B2 * 2/2011 Denzler ..... 239/428.5
2006/0011748 A1 * 1/2006 Ferrari ..... 239/428.5
2008/0210777 A1 * 9/2008 Lacher et al. ..... 239/140
2011/0005627 A1 * 1/2011 Kanemaru et al. ..... 137/801

FOREIGN PATENT DOCUMENTS

DE 3114818 11/1982
DE 3543553 11/1987
DE 3817270 A1 * 11/1989
DE 29902906 5/1999
DE 10354150 3/2005
DE 10354150 B3 * 3/2005 ..... E03C 1/08
EP 1616999 1/2006
WO 9816695 4/1998
WO 2004038113 5/2004
WO 2006018273 2/2006
WO 2006094680 9/2006

* cited by examiner

*Primary Examiner* — Len Tran
*Assistant Examiner* — Viet Le
(74) *Attorney, Agent, or Firm* — Volpe and Koenig, P.C.

(57) ABSTRACT

A jet regulator (1) which can be installed into the water outlet (2) of a sanitary outlet fitting (3), on the front side thereof. The jet regulator (1) can be arranged in a detachable or fixed manner in the water outlet (2). The jet regulator includes at least one holding element (4) for arranging or fixing the jet regulator (1) in the water outlet (2), with the holding element being inserted into a passage opening (5) on the perimeter of the fitting housing and engaging, in a fixed manner, with the end area thereof, the jet regulator (1), which projects into the interior of the fitting housing. The jet regulator (1) has a jet regulator housing (7) with an insertion opening (13) on the peripheral side, with the housing including in the interior at least one insertion guide (14) which is oriented across the jet regulator housing longitudinal axis, and at least one, preferably jet-producing, converter piece (15) can be inserted into the at least one insertion guide (14) from the insertion opening (13).

23 Claims, 7 Drawing Sheets

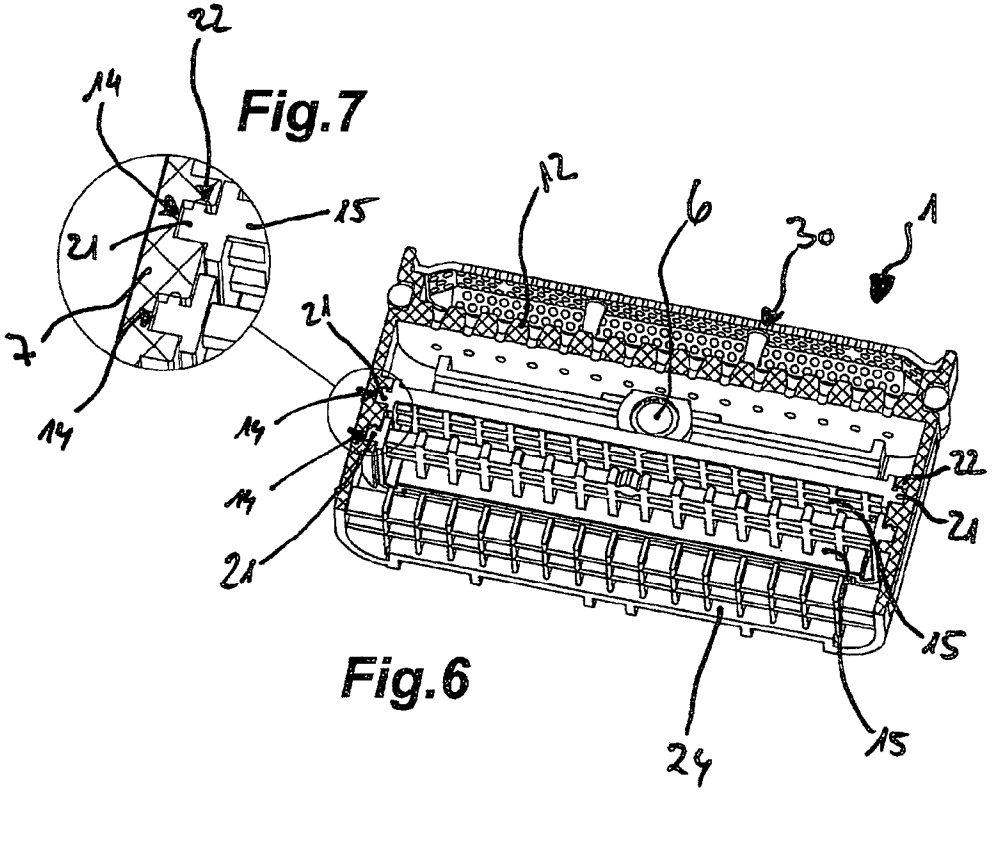
Fig.6
Fig.7
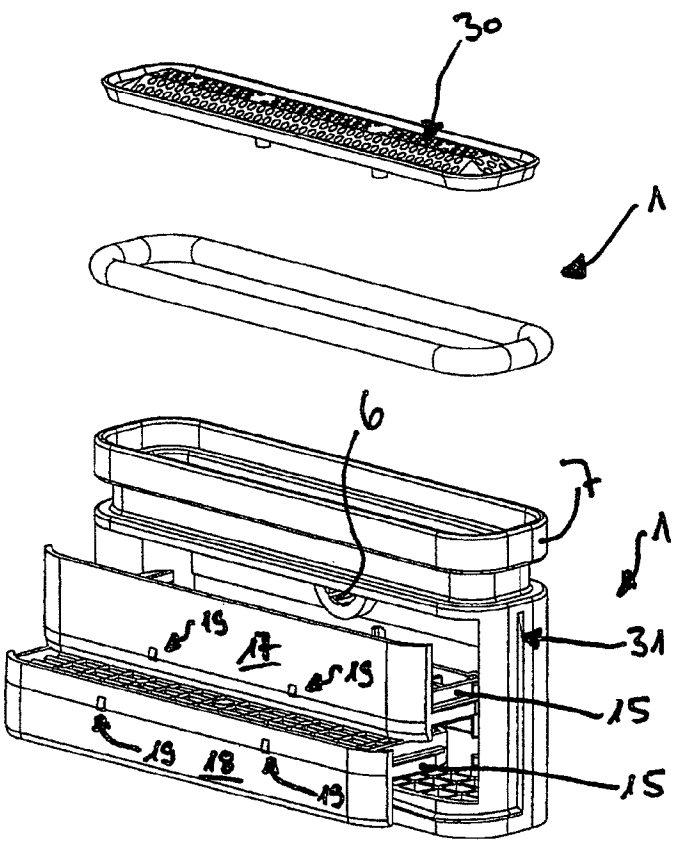
Fig.5

JET REGULATOR

BACKGROUND

The invention relates to a jet regulator which can be inserted into the water outlet of a sanitary outlet fitting from the direction of the outlet end side, with it being possible for the jet regulator to be detachably fastened or fixed in the water outlet.

It is already known for a jet regulator which is to form a homogenous, non-sputtering water jet to be mounted on the water outlet of a sanitary outlet fitting. Such jet regulators are usually inserted into an outlet mouthpiece which can be detachably screwed to the water outlet of the sanitary outlet fitting.

Since the configuration of the outlet mouthpiece in designing the surface of the sanitary outlet fitting may involve a considerable amount of expenditure, and since the gap remaining between the outlet mouthpiece and the outlet fitting is often perceived as a problem, jet regulators of the type mentioned in the introduction have already been created which can be inserted into the water outlet of a sanitary outlet fitting from the direction of the outlet end side without an additional outlet mouthpiece being necessary for fastening the jet regulator.

DE-A-31 14 818 has disclosed a jet regulator which can be inserted into the water outlet of a sanitary outlet fitting. To be able to insert the previously disclosed jet regulator into the water outlet of the outlet fitting, a screw head cap which serves as an outlet mouthpiece is provided on the water outlet, which screw head cap can be screwed by means of a peripheral external thread onto an internal thread which is provided on the inner periphery of the adjacent face-end region of the outlet fitting. The jet regulator previously disclosed by DE-A-31 14 818 is provided as an aerated jet regulator which, for the induction of the air which is to be mixed with the water jet, has air admixture openings which are arranged so as to be distributed about the periphery of its jet regulator housing. Here, an encircling annular gap is provided between the jet regulator housing and the adjacent inner wall of the screw head cap which serves as an outlet mouthpiece, via which annular gap the air which is inducted into the water outlet at the end side can enter into the housing interior of the jet regulator via the air admixture openings which are provided in the jet regulator housing. The jet regulator previously disclosed by DE-A-31 14 818 is inserted into the inflow side insertion opening of the outlet mouthpiece which is designed as a screw head cap and which itself can be screwed to the water outlet of the outlet fitting. Here, the jet regulator previously disclosed by DE-A-31 14 818 has an aeration duct which is designed as an annular gap which runs around the jet regulator housing at all sides. Since the jet regulator housing of the previously disclosed jet regulator surrounds an encircling annular gap, the cross section of the emerging water jet is comparatively small in relation to the outer periphery of the water outlet.

WO-A-98/16695 has already disclosed a jet regulator having a jet diffuser device and a jet regulating device which is connected downstream of said jet diffuser device in the flow direction, with the jet regulating device which is provided in the jet regulator housing of the previously disclosed jet regulator having a plurality of pin-like or annular impact bodies which are spaced apart from one another and which are arranged in the flow path transversely with respect to the flow direction. In all of the exemplary embodiments illustrated in WO-A-98/16695, the jet regulator previously disclosed there has an annular flange which is arranged at the inflow side and which projects beyond the periphery of the jet regulator housing, by means of which annular flange the jet regulator housing can be placed onto the annular shoulder provided at the inner periphery of an outlet mouthpiece. On the jet regulator previously disclosed by WO-A-98/16695 is therefore mounted by means of a conventional outlet mouthpiece on the face-end region, which is provided as a water outlet, of a sanitary outlet fitting. Here, in said previously disclosed jet regulator too, an annular gap is provided between the jet regulator housing and the adjacent inner periphery of the outlet mouthpiece in order that the air for admixture can be inducted into the housing interior of the jet regulator housing via the outlet-side face end of the outlet fitting and the air admixture openings which are distributed about the outer periphery of the jet regulator housing. The jet regulator previously disclosed by WO-A-98/16695 therefore also has the disadvantages already mentioned above with regard to the prior art.

SUMMARY

With the ever-increasing aesthetic demands on sanitary outlet fittings, the demands made of the jet regulators required also increase. It is therefore the object to create a jet regulator of the type mentioned in the introduction in which the water jet leaving the sanitary outlet fitting geometrically continues the contour of the water outlet or of the outlet water-conducting cross-sectional area of the water outlet and therefore assumes the cross-sectional geometry—perpendicular to the flow direction—of the inner contour of the sanitary outlet fitting, which inner contour differs from the visible outer contour only by the wall thickness of the outlet part.

This object is achieved according to the invention in the jet regulator of the type mentioned in the introduction in particular in that an aeration duct which is required for aerating the water jet is delimited, at a part of the periphery arranged so as to face away from the visible side of the outlet fitting, between the jet regulator outer periphery and the fitting inner periphery.

In the jet regulator according to the invention, the aeration duct required for aerating the water jet does not extend—as is conventional—over the entire periphery between the jet regulator periphery and the fitting inner periphery; said aeration duct is in fact delimited at a part of the periphery arranged so as to face away from the visible side of the outlet fitting. Since the air required for generating an aerated jet is inducted not at all sides but rather only at a part of the periphery arranged so as to face away from the visible side of the outlet fitting, the utilization of the available surfaces is increased, which is of particular technical and aesthetic significance in particular in the case of an outlet fitting which is wide but flat in terms of its clear fitting inner periphery.

To achieve the object stated above, a further, independently patentable proposal provides that the length of at least one dimension of the water jet, perpendicular to the flow direction thereof, at the outlet is equal to the outlet inner dimension minus two times the housing wall thickness of the jet regulator.

In order that the jet regulator according to the invention can satisfy even high demands and can be advantageously used in a wide variety of outlet fittings, a further independently patentable proposal provides that, to fasten or fix the jet regulator in the water outlet, at least one retaining element is provided which extends through a passage opening provided on the periphery of the fitting housing and which engages, with its end region protruding into the housing interior of the fitting housing, on the jet regulator so as to fix the latter.

The jet regulator according to the invention may, if required, be inserted into the water outlet of a sanitary outlet fitting from the direction of the outlet end side. To be able to detachably fasten and fix the jet regulator according to the invention there, at least one retaining element is provided which extends through a passage opening provided on the periphery of the fitting housing, with the retaining element engaging, with its end region protruding into the housing interior of the fitting housing, on the jet regulator so as to fix the latter. Since the at least one retaining element may engage on a jet regulator of any desired shape, the jet regulator according to the invention promotes design freedom in the design of new outlet fittings without it being necessary to accept losses in function. Since the jet regulator according to the invention does not require an external thread or a bayonet connection on its housing periphery, it is possible at least in visual terms for practically the entire clear cross section of the outlet fitting, with the exception of the jet regulator housing walls, to serve to conduct water.

The retaining element may duly also act on the jet regulator so as to fix the latter. However, in order that the comparatively thin-walled jet regulator is not deformed to an excessive extent, it may be advantageous for the retaining element to engage into a fastening opening on the jet regulator.

The retaining element may be designed as a retaining splint which extends though the passage opening on the fitting housing and through a fastening opening on the jet regulator. One preferred embodiment of the invention, however, provides that the retaining element is designed as a retaining screw which can be screwed into the passage opening and/or the fastening opening.

It is particularly advantageous if the retaining element has a self-tapping thread and if the retaining element, as it is screwed in, cuts a thread into the fastening opening. It is therefore not necessary for the thread flights in the passage opening on the one hand to be adapted to the thread flights in the fastening opening on the other hand.

The retaining element no longer has an objectionable appearance at the outer periphery of the fitting housing if the retaining element is designed as a set screw and/or if a tool engagement surface, which is preferably designed as an internal hexagon, is provided on the visible end region of the retaining element.

It is particularly expedient if the fastening opening has, on its inner periphery, a profile formed from axial projections and depressions. While the retaining element can cut into the axial projections with little force expenditure, the material which is displaced during the thread-cutting process can be pressed into the region of the depressions, where it no longer poses a problem.

To form a sparkling, soft water jet, it is advantageous if the jet regulator is designed as an aerated jet regulator and if an aeration duct, which is open toward the outlet end side of the water outlet, is provided at least in one partial region between the fitting inner periphery and the jet regulator.

Here, one preferred embodiment according to the invention provides that at least one fastening opening is arranged on the jet regulator housing in the region of the aeration duct.

Since no external thread is required on the jet regulator housing for inserting and fixing the jet regulator according to the invention, the jet regulator according to the invention may also have a non-circular and in particular an elongate and/or rectangular outer periphery.

A further independently patentable proposal according to the invention provides that the jet regulator mentioned in the introduction has a jet regulator housing with a peripheral push-in opening, that at least one push-in guide which is aligned transversely with respect to the jet regulator longitudinal axis is provided in the housing interior of the jet regulator housing, and that at least one preferably jet-forming insert part can be pushed into the at least one push-in guide from the direction of the push-in opening. In the jet regulator according to the invention, the insert parts additionally required for forming the water jet can be pushed into the housing interior of the jet regulator housing from the direction of a peripheral push-in opening. For this purpose, at least one push-in guide which is aligned transversely with respect to the jet regulator longitudinal axis is provided in the housing interior of the jet regulator housing, into which push-in guide at least one preferably jet-forming insert part can be pushed in laterally.

In order that the clear cross section of the water outlet can be utilized practically completely for forming the water jet, it is advantageous if at least one insert part which is provided in a push-in guide extends substantially over the clear passage cross section of the jet regulator housing.

One particularly simple and advantageous embodiment according to the invention provides that at least one insert part is of plate-shaped design.

To perform the function of a jet diffuser, of a homogenizing device and/or of a flow straightener, it may be advantageous if at least one insert part has a preferably jet-forming sieve, grate or mesh structure.

In order that the different functions can be optimized in the jet regulator according to the invention, it can be advantageous if at least two insert parts can be pushed into the jet regulator housing, which insert parts preferably have different sieve, grate or mesh structures.

In order to provide the jet regulator housing which has a lateral push-in opening with a sufficient level of stability, it may be advantageous if a jet diffuser device which is preferably designed as a perforated plate is integrally formed in the jet regulator housing.

To make it possible for the functional units which follow the jet diffuser to be pushed into the jet regulator housing, it is advantageous if the jet diffuser device is formed into the jet regulator housing upstream of the push-in opening at the inflow side.

To prevent undesired leakage currents between the jet regulator on the one hand and the fitting inner periphery on the other hand, it is expedient if an annular seal, a lip seal or similar encircling seal element is provided between the jet regulator and the fitting inner periphery.

A seal element of said type can be sealingly inserted in an effective manner between the jet regulator housing on the one hand and the fitting inner periphery on the other hand without it being necessary for the jet regulator housing to be deformed if the jet regulator housing supports, in the region of the jet diffuser device, a seal element which bears sealingly against the fitting periphery.

To prevent an undesired discharge of water from the push-in opening of the jet regulator housing and to prevent an uncontrolled induction of air through the push-in opening, it is advantageous if a seal is provided between the push-in opening and the fitting inner periphery.

Here, one embodiment according to the invention which is particularly simple and can be produced with little expenditure provides that the seal is designed, at least in regions, as a sealing lip or similar sealing projection which is integrally formed on the jet regulator housing.

Since the push-in opening can be sealed off at its inflow-side edge region even by means of the seal element which encircles around the jet regulator housing, it can be sufficient if the sealing lip or similar sealing projection extends linearly over the peripheral edge region, which delimits the push-in opening, of the jet regulator housing at both sides into the region of the seal element.

One embodiment of the invention provides that a cover is provided to close off the push-in opening and that at least one insert part supports at least one partial region of the cover. When the required insert parts are pushed into the push-in opening, then those partial regions of the cover which are provided on said insert parts finally close off the push-in opening completely.

To also close off the push-in opening in a satisfactorily sealing manner, it is expedient if at least one pressing projection is integrally formed on the cover or on at least one partial region of the cover, which pressing projection acts on the fitting inner periphery. The pressing projection which bears against the fitting inner periphery and which is pressed radially inward as the jet regulator is pushed into the fitting housing in turn presses the cover or cover partial region sealingly against the jet regulator housing.

To further promote the simple production of the jet regulator according to the invention, it is advantageous if the at least one pressing projection is integrally formed on the cover or on the partial region of the cover in the region of the insert part.

To prevent slipping or a release of the insert parts which have been pushed into the jet regulator housing, it may be advantageous if at least one insert part is secured or held in its push-in guide by means of a force-fitting action.

To prevent an undesired manipulation of the insert parts situated in the housing interior of the jet regulator housing, it may be advantageous if a sieve, grate or mesh structure is integrally formed into the jet regulator housing at the outlet side. The sieve, grate or mesh structure which is integrally formed on the jet regulator housing at the outlet side may not only have a jet-forming action but rather also simultaneously performs the function of a manipulation prevention device.

In order that it is possible for the jet regulator which has been pushed preferably completely into the fitting housing to be removed again from the fitting housing as required, it is expedient if at least one tool engagement point for a disassembly tool is provided on the jet regulator housing, preferably in the region of the aeration duct.

BRIEF DESCRIPTION OF THE DRAWINGS

Further features of the invention can be gathered from the following description of the Figures in connection with the claims. The invention is described in yet more detail below on the basis of advantageous exemplary embodiments. In the Figures:

FIG. 5 shows the jet regulator from FIGS. 1 to 4 in an exploded perspective illustration, FIG. 6 shows the jet regulator from FIGS. 1 to 5 in a longitudinally sectioned perspective illustration, FIG. 7 shows a detailed view of the jet regulator illustrated, in a longitudinally sectioned view, in FIG. 6 in the region of the insert parts pushed into the jet regulator housing.

DETAILED DESCRIPTION OF THE PREFERRED EMBODIMENTS

Figure 3:
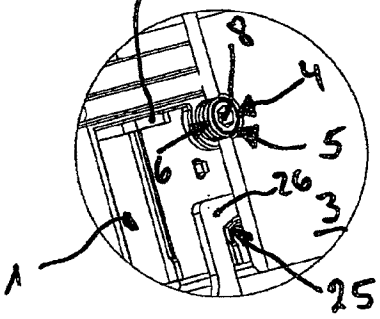
FIG. 3 shows the jet regulator, inserted into the water outlet of the fitting housing, from FIGS. 1 and 2 in the region of a set screw which fixes the jet regulator.
Figure 2:
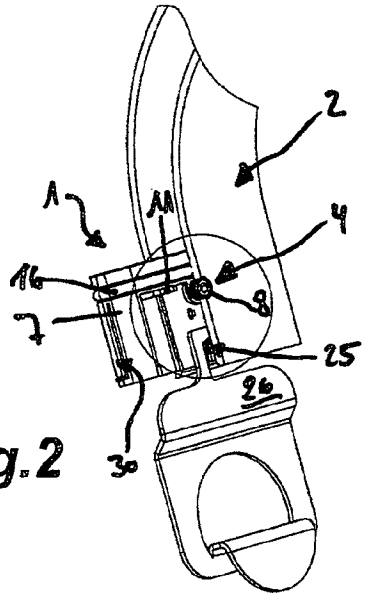
FIG. 2 shows the fitting housing, having the jet regulator, from FIG. 1.
Figure 4:
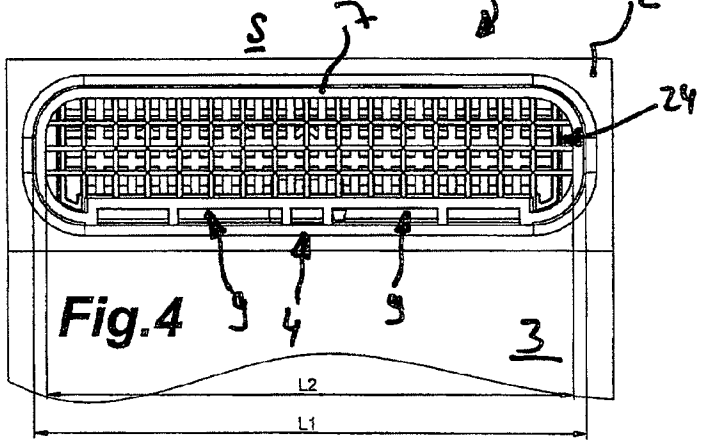
FIG. 4 shows the fitting housing of the outlet fitting, illustrated in FIGS. 1 to 3 in an end view of its water outlet.
Figure 1:
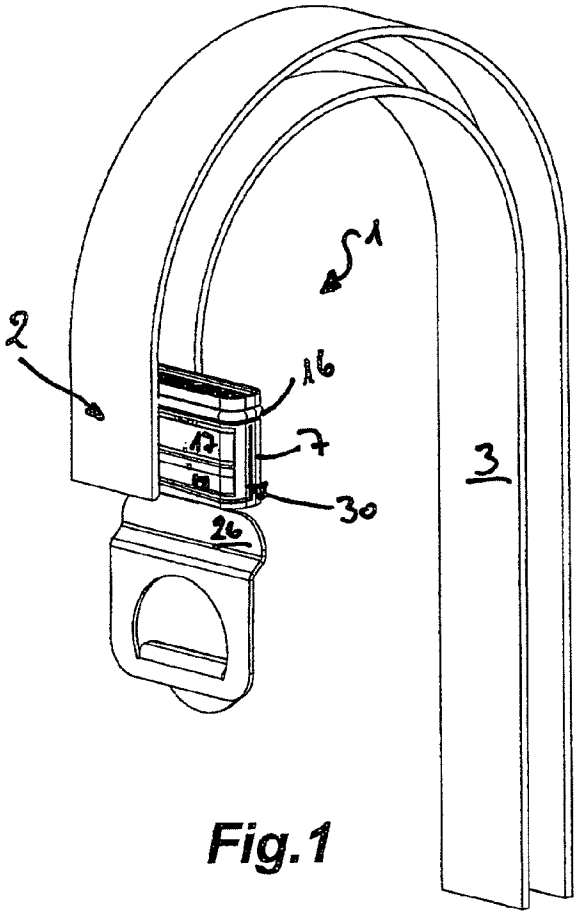
FIG. 1 shows the fitting housing, in a longitudinally cutaway view, of a sanitary outlet fitting which, in the region of its water outlet, has a jet regulator whose outline is elongate and rectangular so as to be matched in terms of shape.

FIGS. 1 to 9 and 10 to 18 illustrate different embodiments 1, of a jet regulator which can be inserted into the water outlet 2 of a sanitary outlet fitting 3 from the direction of the outlet end side in order to form a homogenous, sparkling, soft and non-sputtering water jet there. To fasten and fix the jet regulator 1, 10, which has a non-circular and in this case elongate rectangular outline, in each case one retaining element 4 is provided which extends through a passage opening 5 provided on the periphery of the fitting housing and which engages, with its end region protruding into the housing interior of the fitting housing, on the jet regulator 1, 10 so as to fix the latter.

For this purpose, the retaining element 4 engages into a fastening opening 6 which is provided laterally on the jet regulator housing 7. The retaining element 4 is designed, in the exemplary embodiments shown in FIGS. 1 to 9 and 10 to 18, as a retaining screw and in particular as a set screw which can be screwed into the passage opening 5 on the fitting housing and into the fastening opening 6 on the jet regulator housing 7. In order that the set screw 4 no longer has an objectionable appearance at the outer periphery of the fitting housing, the set screw 4 has, on its visible end region, a tool engagement surface, which is designed as an internal hexagon 8, for a hexagonal key.

To facilitate the assembly of the jet regulator in the water outlet of the outlet fitting, the retaining element 4 has a self-tapping thread, by means of which the retaining element 4, as it is screwed in, cuts a thread into the fastening opening 6. As is clear from FIGS. 5 and 6 or 14, the fastening opening 6 has, at its inner periphery, a profile formed from axial projections and depressions, with the retaining element 4 cutting with its self-tapping thread into the projections of the fastening opening 6, while the material which is thereby displaced can be pressed into the depressions.

The jet regulators 1, 10 illustrated in FIGS. 1 to 9 and 10 to 18 are aerated jet regulators in which air is admixed to the water jet. To be able to induct the air required for the air admixture into the housing interior of the jet regulator 1, 10, an aeration duct 9, which is open toward the outlet end side of the water outlet 2, is provided in one partial region between the fitting inner periphery and the jet regulator 1, 10. The aeration duct 9 opens out in the region of aeration openings 11 which are provided in the jet regulator housing 7 and which lead, below a jet diffuser 12, into the housing interior. Here, the fastening opening 6 is arranged on the jet regulator housing 7 in the region of the aeration duct 9.

From a comparison of FIGS. 5 to 7 and 14 to 16, it is clear that the jet regulators 1, 10 shown here have a jet regulator housing 7 with a peripheral push-in opening 13. Here, at least one push-in guide 14 which is aligned transversely with respect to the jet regulator longitudinal axis is provided in the housing interior of the jet regulator housing 7, such that the insert parts 15 required for forming the water jet can be pushed into the push-in guide or push-in guides 14 from the direction of the push-in opening 13. To be able to form the water jet over the entire cross section thereof, the plate-shaped insert parts 15 extend substantially over the entire clear passage cross section of the jet regulator housing 7. It can be seen from FIGS. 5, 9 and 14 that the insert parts 15 which serve here as a homogenization device have a jet-forming sieve or grate structure.

A jet diffuser device 12 which is designed as a perforated plate is integrally formed in the jet regulator housing 7 upstream of the push-in opening 13 at the inflow side. To prevent undesired leakage currents between the jet regulator housing 7 on the one hand and the fitting inner periphery on the other hand, an annular seal 16 is provided between the jet regulator 1, 10 and the fitting inner periphery. The annular seal 16 which is supported by the jet regulator housing 7 in the region of the jet diffuser device 12 can bear sealingly against the fitting housing without the risk of a deformation of the jet regulator housing 7 in said region, since the jet diffuser device 12 serves to stiffen the jet regulator housing 7 and counteracts an undesired deformation.

It can be seen from FIGS. 1 to 10 that the push-in opening 13 of the jet regulator 1 can be closed off by means of a cover which is formed from a plurality of cover partial regions 17, 18 which are integrally formed on the insert parts 15. Pressing projections 19 are integrally formed on said cover partial regions at the outside, which pressing projections 19 act on the fitting inner periphery. As the jet regulator 1 is inserted, said pressing projections 19 are clamped between the fitting inner periphery and the jet regulator housing 7 in such a way that the pressing projections 19 press the cover partial regions 17, 18 against the peripheral edge region, which delimits the push-in opening 13, of the jet regulator housing 7 with a sufficient sealing action.

It can be seen from FIGS. 10 to 18 that the push-in opening 13 of the jet regulator 10 is not assigned any cover. Instead, only a seal 31 is provided here between the push-in opening 13 and the fitting inner periphery, which seal 31 is intended to prevent an undesired discharge of water and an uncontrolled inflow of air. Said seal is also designed here at least in regions as a sealing lip 31 which is integrally formed on the outside of the jet regulator housing 7. Since the push-in opening 13 is already sealed off at its inflow-side edge region by the annular seal 16, the sealing lip 31 extends linearly over the peripheral edge region, which delimits the push-in opening 13 of the jet regulator 10, of the jet regulator housing 7 at both sides into the region of the annular seal 16.

It can be seen in FIG. 7 that the insert parts 15 can be pushed with lateral guide rails 21 into the push-in guides 14 which are designed at both sides as guide grooves. Clamping strips 22 project from said guide rails 21, which clamping strips 22 hold the insert parts 15 in their push-in guide 14 by means of a force-fitting action.

Figure 9:
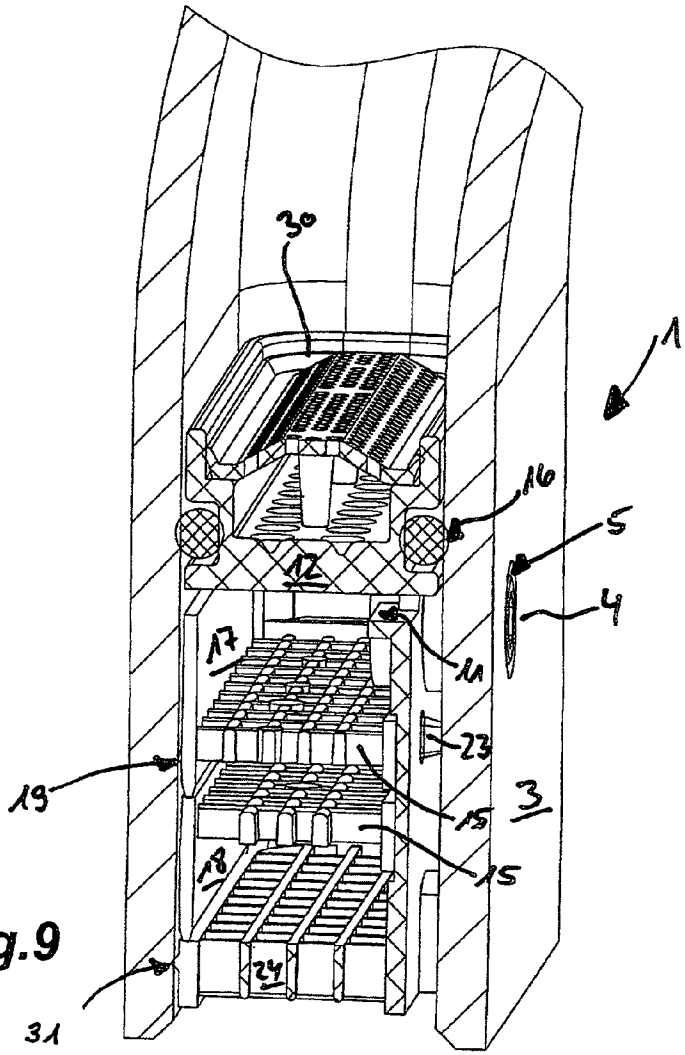
FIG. 9 shows a cross section of the jet regulator from FIGS. 1 to 8 fixed in the fitting housing.
Figure 8:
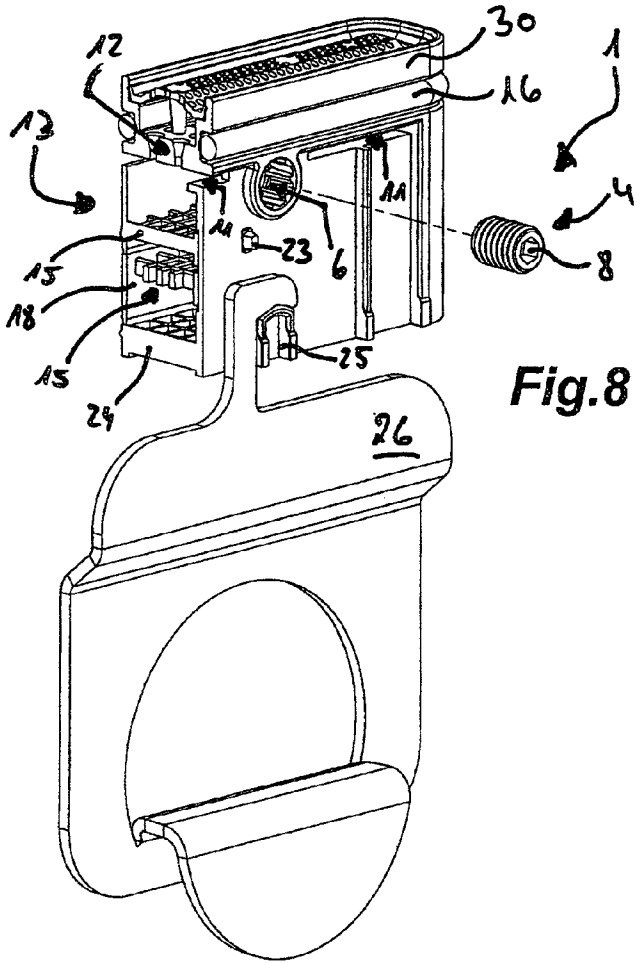
FIG. 8 shows the jet regulator illustrated in FIGS. 1 to 7 in a cross-sectioned perspective illustration, with a disassembly tool engaging on the jet regulator.
Figure 12:
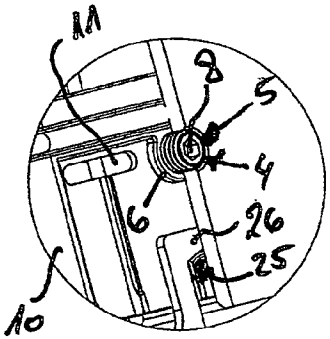
FIG. 12 shows the jet regulator, situated in the water outlet of the fitting housing, from FIGS. 10 and 11 in the region of the set screw which fixes the jet regulator.
Figure 11:
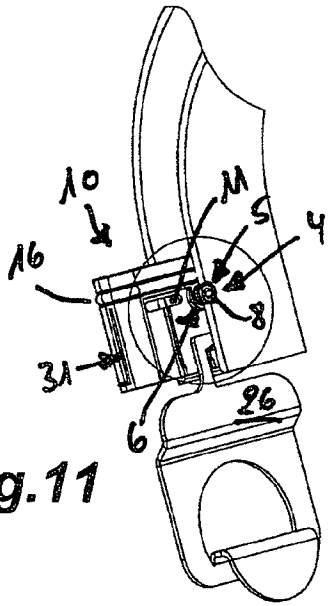
FIG. 11 shows the jet regulator fixed in the fitting housing from FIG. 10, with the fitting housing being illustrated in the region of its water outlet which supports the jet regulator.
Figure 13:
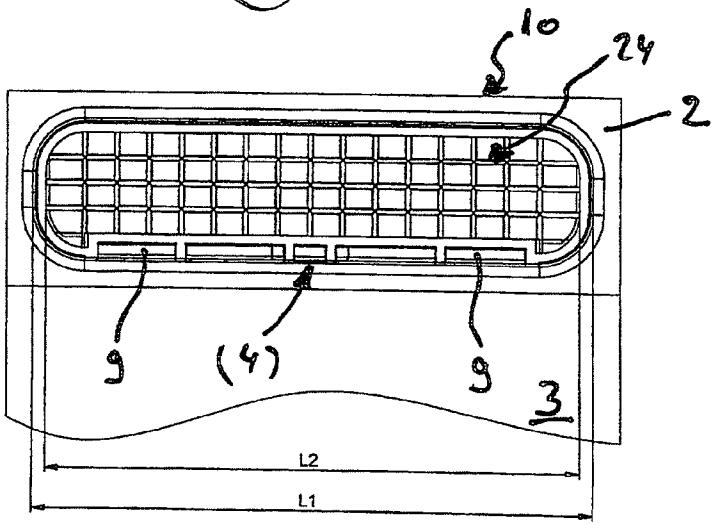
FIG. 13 shows the fitting housing of the outlet fitting illustrated in FIGS. 10 to 12 in an end view of its water outlet.
Figure 10:
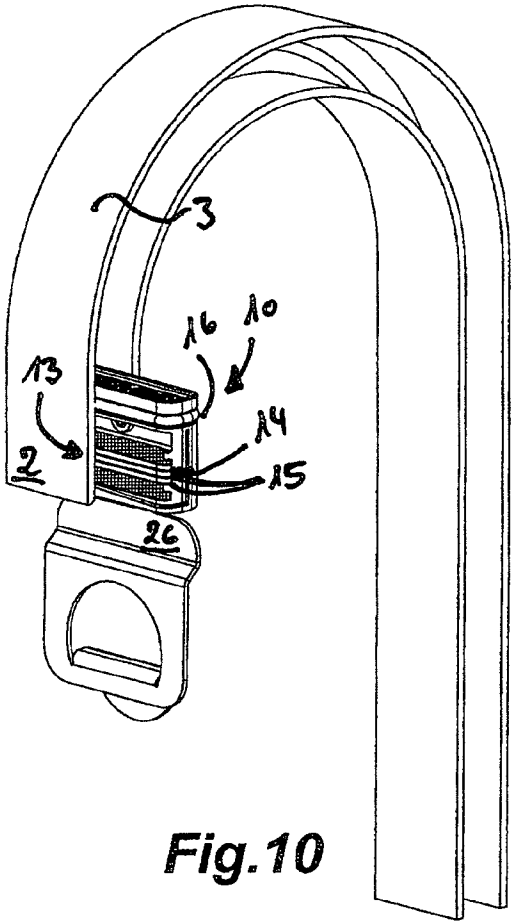
FIG. 10 shows a further embodiment of a jet regulator inserted into a fitting housing of a sanitary outlet fitting.
Figures 14, 15, 16:
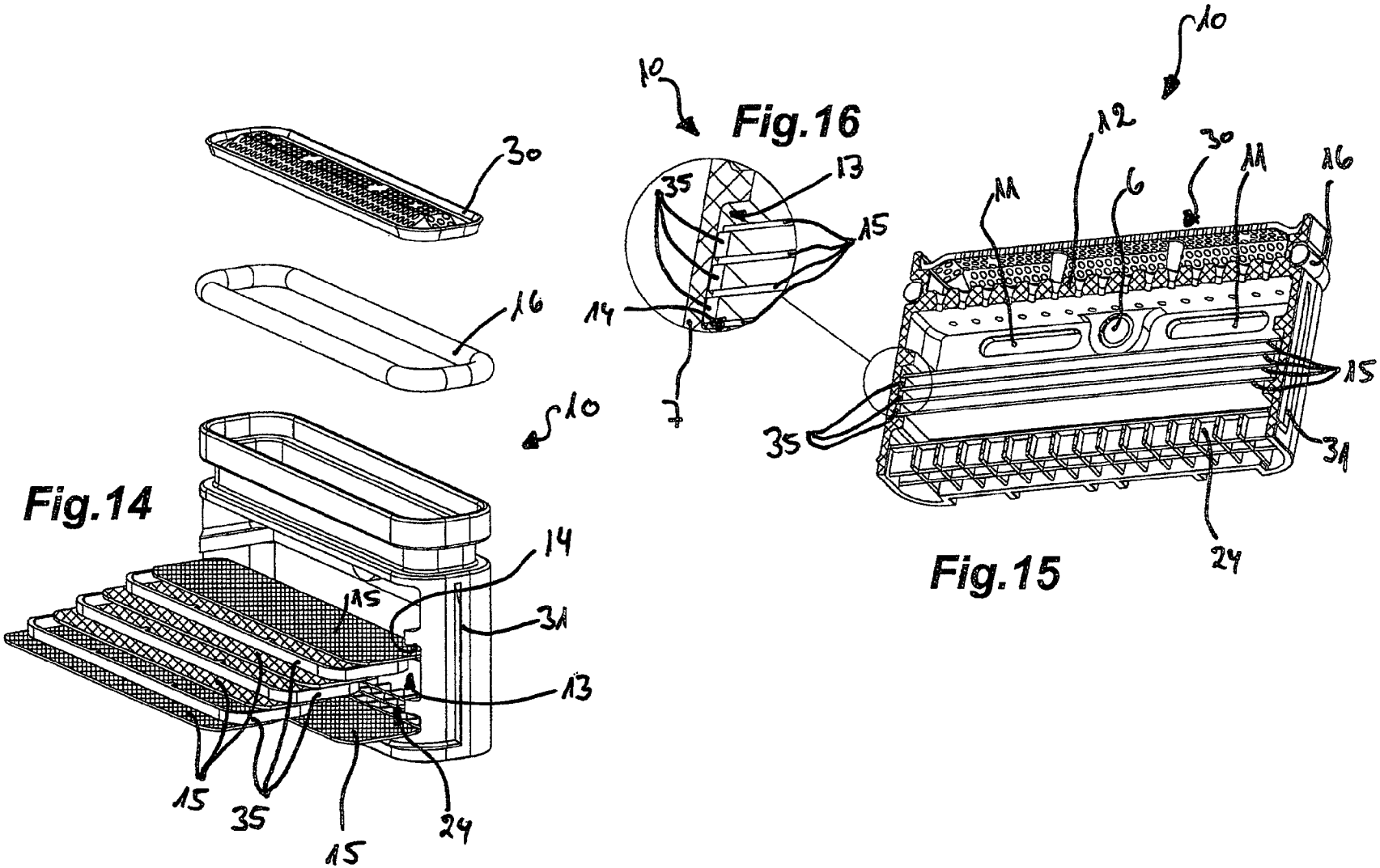
FIG. 14 shows the jet regulator illustrated in FIGS. 10 to 13 in an exploded perspective illustration.
FIG. 15 shows the jet regulator from FIGS. 10 to 14 in a longitudinal section.
FIG. 16 shows a detailed view of the jet regulator illustrated in a longitudinally sectioned view in FIG. 15.
Figure 18:
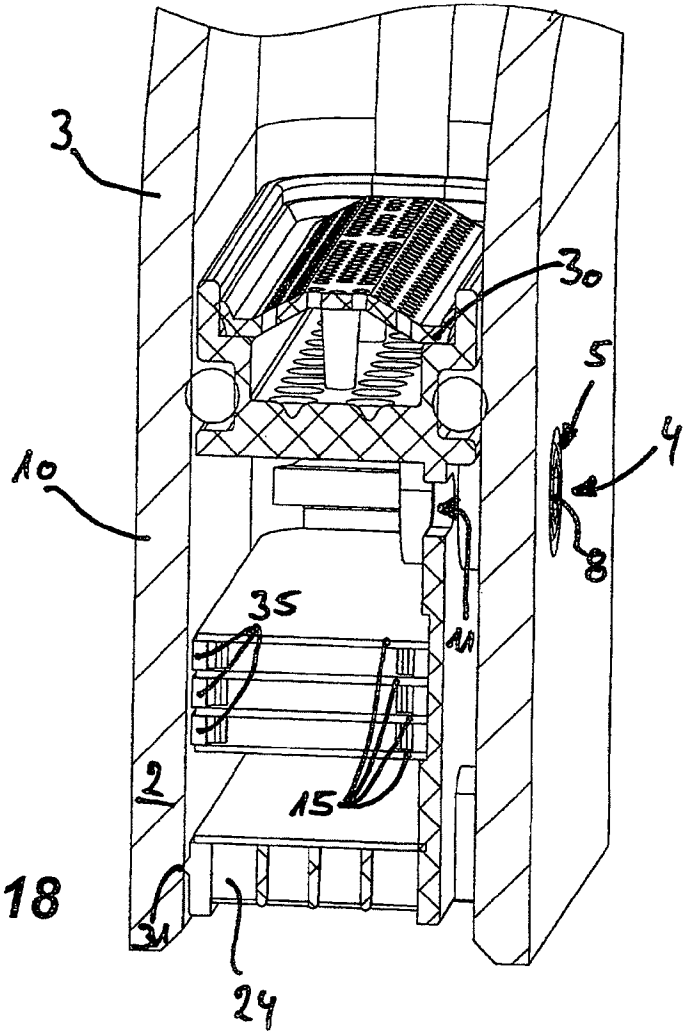
FIG. 18 shows a cross section of the jet regulator from FIGS. 10 to 17 fixed in the water outlet of the fitting housing.

It is clear from a comparison of FIGS. 8 and 9 that the insert part 15 which is situated directly downstream of the jet diffuser device 12 at the outflow side has at least one centering pin 23 which engages into a centering opening on the jet regulator housing 7. Correct positioning between the jet diffuser device 12 on the one hand and the functional unit 15, which follows said jet diffuser device 12 at the outflow side, on the other hand is ensured by means of the centering pin 23 engaging into the centering opening of the jet regulator housing 7, in such a way that the individual jets formed in the jet diffuser device 12 impinge directly on a crossing node of the sieve or grate structure formed by the outflow-side insert part 15.

A sieve or grate structure 24 is integrally formed on the jet regulator housing 7 of the jet regulator 1, 10 at the outlet side, which sieve or grate structure firstly serves as a flow straightener and secondly also constitutes a manipulation prevention device which is intended to prevent unauthorized manipulation of the insert parts 15 situated in the housing interior of the jet regulator housing 7.

Figure 17:
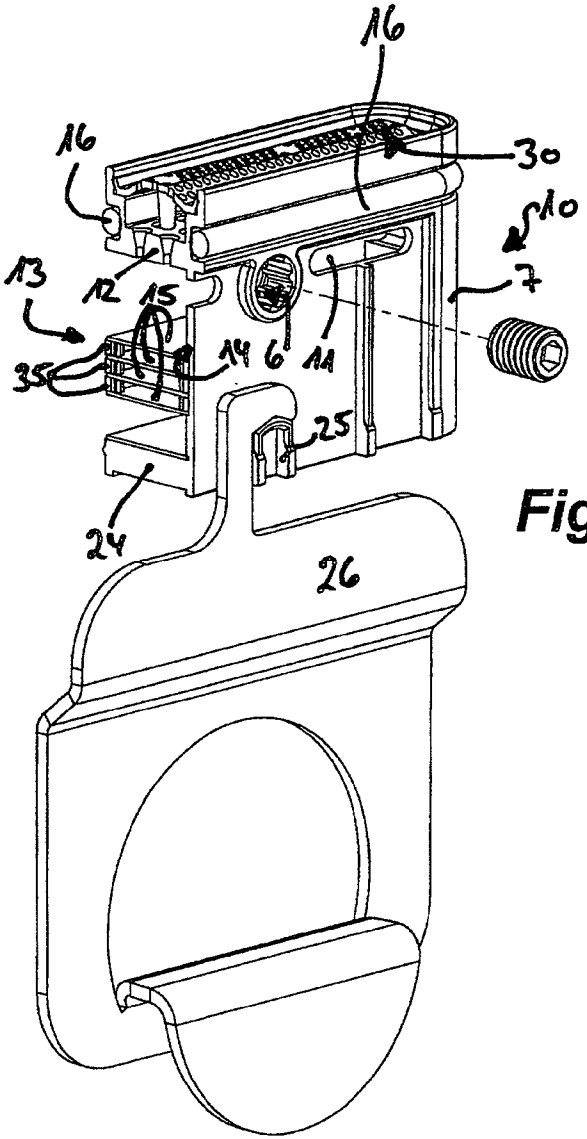
FIG. 17 shows the jet regulator from FIGS. 10 to 16 in a cross-sectioned perspective illustration, with a disassembly tool engaging on the jet regulator outer periphery.

It is clear in particular from FIGS. 8 and 17 that a tool engagement point 25 which is designed as a hook-in projection is provided on the jet regulator housing 7 preferably in the region of the aeration duct, for a disassembly tool 26 which is designed here in the manner of a hook. The jet regulator housing 7 which is situated in the water outlet 2 of the sanitary outlet fitting 3 can be removed from the water outlet as required by means of the disassembly tool 26 which engages behind the tool engagement point 25.

Figure 19:
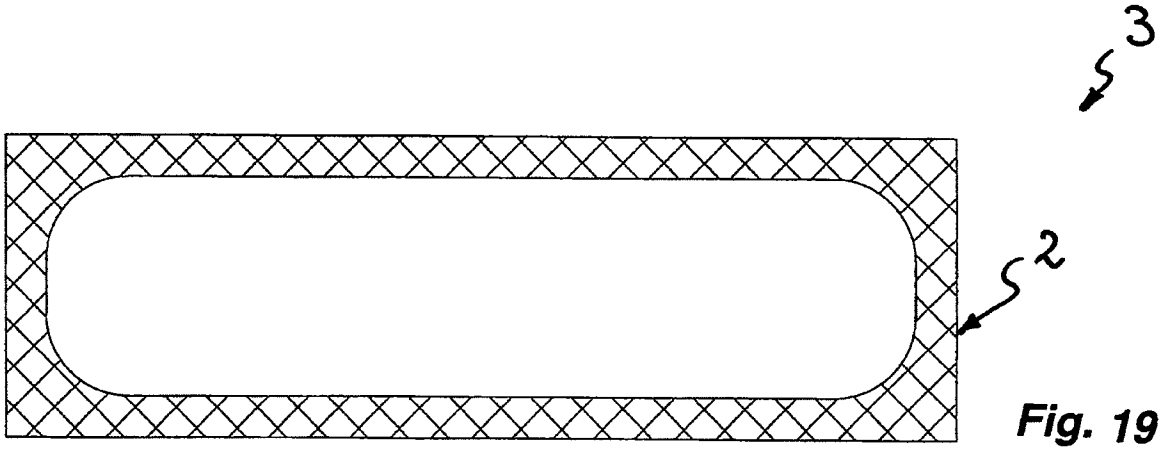
FIG. 19 shows the water outlet of a sanitary outlet fitting, wherein the housing of the sanitary outlet fitting is illustrated with hatching and the tube cross-sectional area which is bordered by said sanitary outlet fitting is illustrated without hatching.
Figure 20:
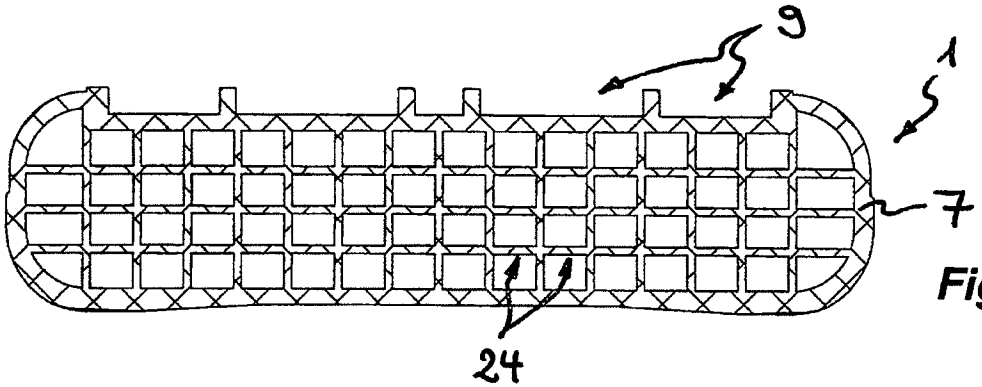
FIG. 20 shows a jet regulator similar to that in FIGS. 1 to 18 in a plan view of its outflow-side end side, wherein the housing contour of the jet regulator and the flow straightener provided at the outflow side are illustrated with hatching and the water outlet areas bordered by said housing contour and flow straightener are illustrated without hatching.

It is a particular advantage of the jet regulators 1, 10 illustrated here that their outlet area A4 which is calculated without the jet regulator housing or the sieve or grate structure and which is bordered and unhatched in FIG. 20 is kept comparatively large in relation to the clear inner cross-sectional area A3, which is bordered and unhatched in FIG. 19, of the water outlet 2. Calculating the area ratio of the sum A4 of the individual water outlet areas (illustrated in FIG. 20) out of the structure of the jet regulator in relation to the unhatched structural area in the sanitary outlet fitting shown in FIG. 19 yields a water outlet area A4 of 50% of the available gross area A3 of the outlet bore at the water outlet 2 of the outlet fitting 3. Here, it may be advantageous if said water outlet area is greater than/equal to 0.3 and in particular greater than/equal to 0.4 of the gross area, preferably 0.45 and in particular greater than/equal to 0.5 of the gross area of the outlet bore of the fitting outlet. Viewed from the visible side S, the length $L_2$ of the water jet at the outlet of the jet regulator in comparison to the length $L_1$ of the clear cross-sectional length of the outlet fitting is >0.8, preferably 0.9.

From a comparison of FIGS. 1 to 9 on the one hand and FIGS. 10 to 18 on the other hand, it is clear that the jet regulator 1 has, for each of its insert parts 15, in each case one push-in guide 13, whereas the jet regulator 10 has only one push-in guide 13, into which a plurality of insert parts 15 can be pushed. The insert parts 15 of the jet regulator 10 shown in FIGS. 10 to 18 are held with a spacing to one another by means of spacer frames 35.

It may be advantageous for the water flow to be subjected to a greater resistance at the side edges of the insert parts 15. For this purpose, it is possible for a greater number of webs which form the sieve or grate structure to be provided at the side edges of the insert parts 15, such that only a relatively small water quantity can pass and spraying of the emerging water jet at the jet periphery can be prevented or at least reduced. If, instead, a lower number of webs are provided at the side edges of the insert parts 15, and if the water jet is thereby subjected to a reduced resistance in the region of the side edges of the insert parts, it is possible to ensure the cylindrical shape of the emerging water jet over a relatively long distance, which is desirable in particular in the case of elongate jet regulators.

It is particularly advantageous if the sieve or grate structures of the insert parts 15 which are positioned in series with one another to be aligned with the gaps of the adjacent structures. Even if the insert parts 15 are of identical design, this is possible by means of a lateral offset of the sieve or grate structures for example by approximately half of a mesh width. Instead, it is also possible to use asymmetrical sieve or grate structures which can be aligned with the gaps of the adjacent structures by means of a simple rotation of the identically-designed insert parts 15.

In each case one ancillary sieve 30 is positioned upstream of the jet regulators 1, 10 at the inflow side, which ancillary sieve 30 filters out the dirt particles contained in the water.

The invention claimed is:

1. A jet regulator (1, 10) which can be inserted into a water outlet (2) of a sanitary outlet fitting (3) from a direction of an outlet end side, with the jet regulator (1, 10) being detachably fastened or fixed in the water outlet (2), the jet regulator has a rectangular outline and comprises an aeration duct (9), which is delimited only at a part of a periphery of the jet regulator arranged away from a front side (S) of the outlet fitting (3), between an outer periphery of the jet regulator and an inner periphery of the fitting (3), with a remaining portion of the periphery of the jet regulator arranged toward the front side (S), which does not include any aeration duct.

2. The jet regulator as claimed in claim 1, wherein the jet regulator (1, 10) comprises an aerated jet regulator and the aeration duct (9), which is open toward the outlet end side of the water outlet (2), is provided at least in one partial region between the fitting inner periphery and the jet regulator (1, 10).

3. The jet regulator as claimed in claim 2, wherein at least one fastening opening (6) is arranged on a housing (7) of the jet regulator in a region of the aeration duct (9).

4. The jet regulator as claimed in claim 1, wherein the jet regulator has a jet regulator housing with a peripheral push-in opening, at least one push-in guide (14) which is aligned transversely with respect to a longitudinal axis of the jet regulator is provided in a housing interior of the jet regulator housing, and at least one jet-forming insert part (15) can be pushed into the at least one push-in guide (14) from a direction of the push-in opening.

5. The jet regulator as claimed in claim 4, wherein at least one insert part (15) which is provided in the push-in guide (14) extends substantially over a clear passage cross section of the jet regulator housing (7).

6. The jet regulator as claimed in claim 5, wherein the at least one insert part (15) is plate-shaped.

7. The jet regulator as claimed in claim 5, wherein the at least one insert part (15) has a jet-forming sieve, grate or mesh structure.

8. The jet regulator as claimed in claim 5, wherein at least two of the insert parts (15) can be pushed into the jet regulator housing (7).

9. The jet regulator as claimed in claim 8, wherein the insert parts (15) which can be pushed into the jet regulator housing (7) have different sieve, grate or mesh structures.

10. The jet regulator as claimed in claim 4, wherein a jet diffuser device (12) comprising a perforated plate is integrally formed in the jet regulator housing (7).

11. The jet regulator as claimed in claim 10, wherein the jet diffuser device (12) is formed into the jet regulator housing (7) upstream of the push-in opening (13) at the inflow side.

12. The jet regulator as claimed in claim 1, wherein an annular seal (16) is provided between the jet regulator (1, 10) and the fitting inner periphery.

13. The jet regulator as claimed in claim 10, wherein the jet regulator housing (7) supports, in the region of the jet diffuser device (12), an annular seal (16) which bears sealingly against the fitting inner periphery.

14. The jet regulator as claimed in claim 13, wherein a seal is provided between the push-in opening (13) and the fitting inner periphery.

15. The jet regulator as claimed in claim 14, wherein the seal is designed, at least in regions, as a sealing lip (31) or similar sealing projection which is integrally formed on the jet regulator housing.

16. The jet regulator as claimed in claim 15, wherein the sealing lip (31) or similar sealing projection extends linearly over a peripheral edge region, which delimits the push-in opening (13), of the jet regulator housing (7) at both sides into the region of the annular seal (16).

17. The jet regulator as claimed in claim 5, wherein a cover is provided to close off the push-in opening (13) and the at least one insert part (15) supports at least one partial region (17, 18) of the cover.

18. The jet regulator as claimed in claim 5, wherein the at least one insert part (15) is secured or held in the push-in guide (14) by means of a force-fitting action.

19. The jet regulator as claimed in claim 1, wherein a sieve, grate or mesh structure is integrally formed into the jet regulator housing at the outlet side.

20. The jet regulator as claimed in claim 1, wherein at least one tool engagement point (25) for a disassembly tool (26) is provided on the jet regulator housing (7).

21. The jet regulator (1, 10) of claim 1, wherein the rectangular outline has rounded corners.

22. A jet regulator (1, 10) which can be inserted into a water outlet (2) of a sanitary outlet fitting (3) from a direction of an outlet end side, with the jet regulator (1, 10) being detachably fastened or fixed in the water outlet (2), the jet regulator comprises an aeration duct (9), which is required for aerating a water jet that is delimited only at a part of a periphery of the jet regulator arranged to face away from a visible side of the outlet fitting (3), between an outer periphery of the jet regulator and an inner periphery of the fitting, with a remaining portion of the periphery of the jet regulator arranged to face the visible side not including any aeration duct, the jet regulator having a jet regulator housing with a peripheral push-in opening, at least one push-in guide (14) which is aligned transversely with respect to a longitudinal axis of the jet regulator is provided in a housing interior of the jet regulator housing, and at least one jet-forming insert part (15) can be pushed into the at least one push-in guide (14) from a direction of the push-in opening, which extends substantially over a clear passage cross section of the jet regulator housing (7), cover is provided to close off the push-in opening (13) and the at least one insert part (15) supports at least one partial region (17, 18) of the cover; at least one pressing projection (19) is integrally formed on the cover or on at least one partial region (17, 18) of the cover, the pressing projection (19) acts on the fitting inner periphery.

23. The jet regulator as claimed in claim 22, wherein the at least one pressing projection (19) is integrally formed on the cover or on the partial region (17, 18) of the cover in the region of the insert part (15).

* * * * *